United States Patent [19]

O'Hara

[11] Patent Number: 4,616,867

[45] Date of Patent: Oct. 14, 1986

[54] MEASURING SCOOP

[76] Inventor: John J. O'Hara, 3689 Karen Pkwy., Pontiac, Mich. 48054

[21] Appl. No.: 742,658

[22] Filed: Jun. 10, 1985

Related U.S. Application Data

[63] Continuation of Ser. No. 319,452, Sep. 29, 1983, abandoned.

[51] Int. Cl.[4] ..... A47F 13/08; G01F 19/00

[52] U.S. Cl. ..... 294/55; 73/426; D7/50; D7/104

[58] Field of Search ..... 294/1 R, 55; D7/50, D7/102, 104, 137, 150; 30/324–327; 73/426–429

[56] References Cited

U.S. PATENT DOCUMENTS

| | | | |
|---|---|---|---|
| D. 32,149 | 1/1900 | Burwell | D7/104 |
| D. 43,123 | 10/1912 | Strassburger et al. | D7/104 |
| D. 141,881 | 7/1945 | Mathewson | D7/50 X |
| D. 153,674 | 5/1949 | Erker | D7/104 X |
| D. 154,022 | 6/1949 | Bretney | D7/50 |
| D. 236,066 | 7/1975 | Best | D7/104 |
| D. 269,240 | 6/1983 | Kelson | D7/50 |
| 780,492 | 1/1905 | Boutelle | 30/324 |
| 1,728,858 | 9/1929 | Dreher | 294/55 |
| 2,799,086 | 7/1957 | Tupper | 73/426 X |
| 2,807,168 | 9/1957 | Wipf | 73/427 |
| 3,013,436 | 12/1961 | Dailey | 73/426 |

*Primary Examiner*—Johnny D. Cherry

*Attorney, Agent, or Firm*—Gifford, Groh, VanOphem, Sheridan, Sprinkle & Dolgorukov

[57] ABSTRACT

A measuring scoop having a housing including a peripheral wall with an elongated flat portion for engagement with a flat support surface. A handle is formed with the housing at a position spaced apart from the elongated flat portion. The housing defines an open ended chamber adapted to receive a predetermined amount of chopped, diced or ground food product by sliding the scoop across the flat surface.

1 Claim, 3 Drawing Figures

MEASURING SCOOP

This application is a continuation of application Ser. No. 319,452, filed Sept. 29, 1983 now abandoned.

BACKGROUND OF THE INVENTION

I. Field of the Present Invention

The present invention relates generally to material handling tools, and more particularly, to a kitchen utensil having a receptacle with a predetermined volume.

II. Description of the Prior Art

There are previously known scoops and cups particularly sized to receive a predetermined volume of food product therein. However, the previously known scoops and cups do not include a sidewall which conforms with a flat surface so that a pile of chopped, diced or ground food products can be introduced to the scoop or cup without repeated manipulations of the scoop through the food product.

SUMMARY OF THE PRESENT INVENTION

The present invention overcomes the above-mentioned disadvantages by providing a scoop having a housing including a peripheral wall defining an open ended chamber with a predetermined volume, wherein one portion of the peripheral wall is an elongated flat wall portion. The scoop also includes a handle extending outwardly from the housing.

In the preferred embodiment, the handle is spaced apart from the flat elongated wall portion so that the handle can be easily grasped and lifted when the scoop is rested on the flat peripheral wall portion. In any event, the receptacle chamber can be formed to define a predetermined volume, preferably in accordance with conventional standards of measurement such as tablespoons, cups, ounces, or metric measurements.

Thus the present invention provides a scoop having an elongated flat side that can be scraped along a flat surface, such as a cutting board surface in order to introduce a predetermined amount of chopped, diced or ground food products into the scoop. Moreover, the device is easily maneuvered and readily grasped by placement of a handle extending from the housing.

BRIEF DESCRIPTION OF THE DRAWING

The present invention will be more readily understood by reference to the following detailed description of the preferred embodiment, when read in conjunction with the accompanying drawing in which like reference characters refer to like parts throughout the several views, and in which.

DETAILED DESCRIPTION OF A PREFERRED EMBODIMENT OF THE PRESENT INVENTION

Figure 1:
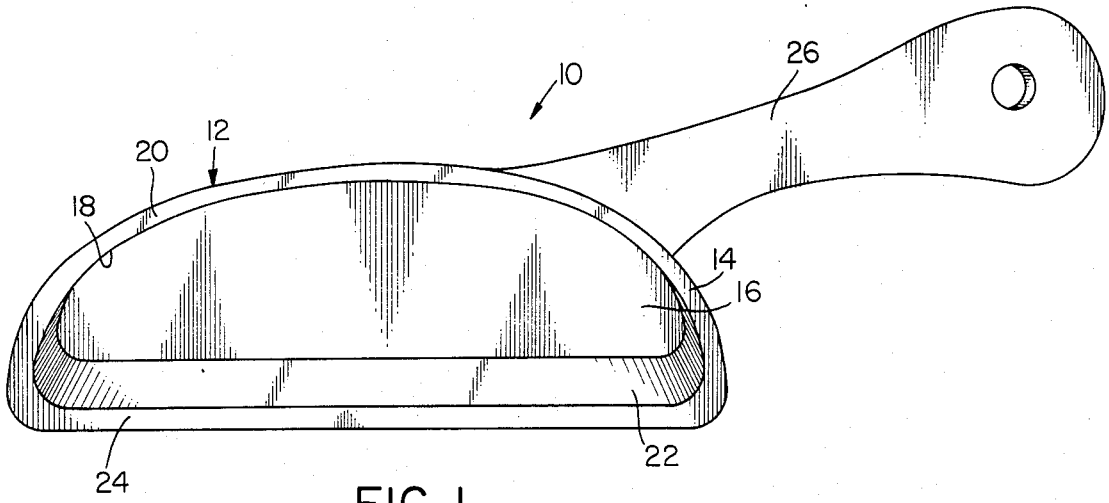
FIG. 1 is a front elevational view of the measuring scoop in accordance with the present invention.

Referring first to FIG. 1, the scoop 10 according to the present invention is thereshown comprising a housing 12 having a peripheral sidewall 14 and an end wall 16. The other end of the peripheral sidewall 14 is open, whereby housing 12 defines an open-ended chamber 18.

The peripheral sidewall 14 includes an arcuate portion 20 mating with a substantially flat elongated portion 22. The wall portion 22 thus defines a narrow edge 24 at the open end of the housing 12 which can be slid along a flat surface in order to introduce chopped, diced or ground food products into the chamber 18.

Figure 2:
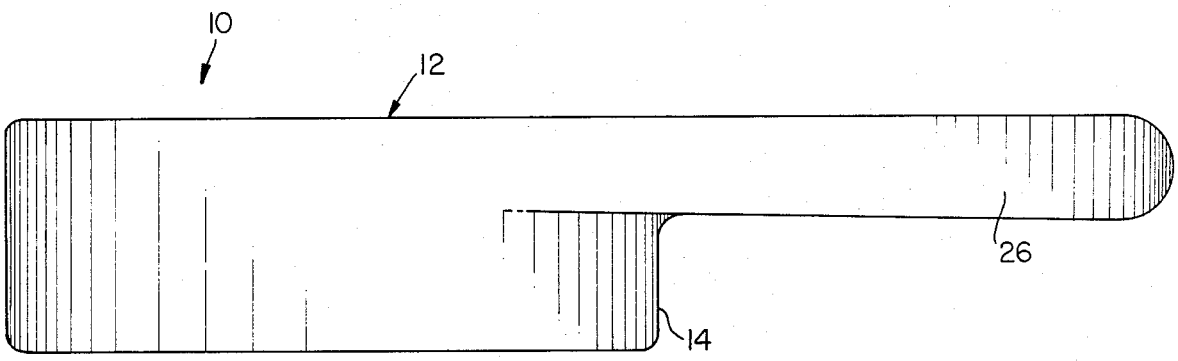
FIG. 2 is a top plan view of the scoop shown in FIG. 1.

The scoop 10 also includes a handle 26 which extends outwardly from the housing 12. Preferably as shown in FIG. 1, the handle is positioned above the flat wall portion 22 and extends outwardly from the arcuate wall portion 20. Although handle 26 extends to the right from the housing 12 as shown in FIG. 1, it will be understood that the handle can also be attached to extend toward the left so that the scoop is conveniently configured for use by the left hand of a person. In addition, as best shown in FIG. 2, the handle is secured near the closed end of the housing 12 so as to be recessed away from the front edge 24 and therefore increases the leverage applied by the handle about the edge 24 to ease manipulation of the scoop.

The scoop can be constructed of any substantially rigid material, such as metal, wood or plastic, as long as the finished scoop can be readily cleaned and substantially retains its shape. Thus, depending upon the material that is used to construct the scoop, the scoop can be cast, carved or stamped, and as shown in the drawing of the preferred embodiment, can be integrally constructed.

Figure 3:
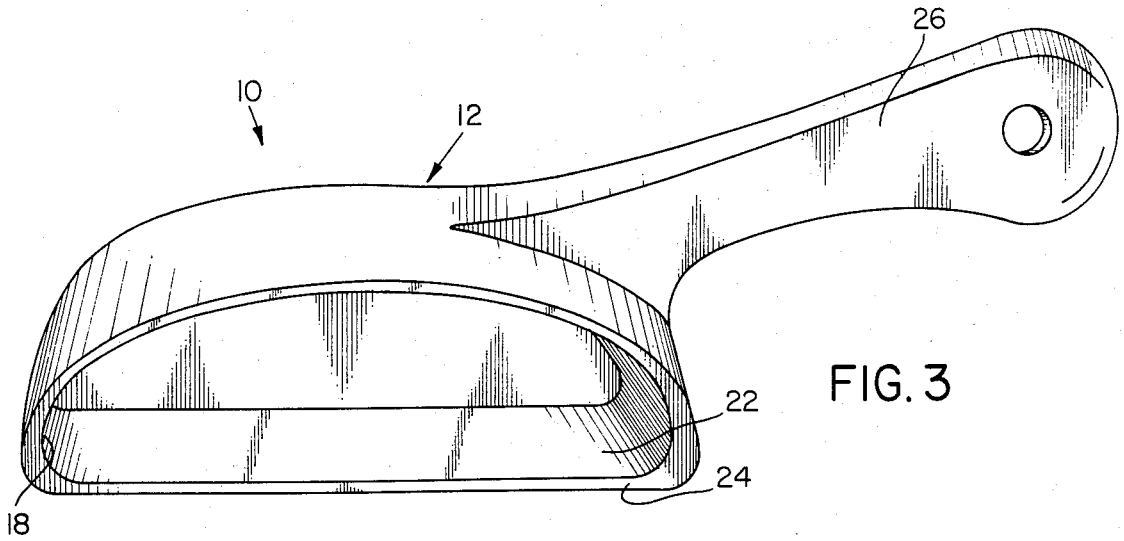
FIG. 3 is a perspective view of the scoop shown in FIGS. 1 and 2.

Having thus described the important structural features of the present invention, it can be readily understood that the scoop is easily manipulated for receiving and transporting predetermined amounts of chopped, diced or ground food products from a flat surface. The raised handle permits the scoop to be easily lifted, manipulated and tilted as shown in FIG. 3 so that a pile of chopped, diced or ground food product can be introduced into the chamber 18 by urging the open end of the housing toward the food product on a flat surface with the edge 24 engaged against the flat surface. The flat wall portion acts as a base while the spacing between the handle and the elongated flat wall portion maintains the handle in its raised position. Thus, once the scoop 10 has been urged into an accumulation of the food product, and the handle rotated so that the open end of the housing 12 faces upwardly, a leveled predetermined amount of the food product will be available for use, for example as a required ingredient for a prepared food.

Having thus described my invention, many modifications thereto will become apparent to those skilled in the art to which it pertains without departing from the scope and spirit of the present invention as defined in the appended claims.

What is claimed is:

1. A measuring scoop comprising:

a housing having a peripheral wall, an end wall, and an open end, thereby defining an open-ended chamber, said peripheral wall having an elongated, flat portion defining an elongated narrow edge along a corresponding portion of the open end, and an arcuate wall portion extending over said elongated, flat portion, the distance between a midpoint of said arcuate wall portion and said elongated flat portion being substantially less than the length of said flat portion whereby said open end of said housing is elongated having one flat side and one arcuate side, an elongated handle integrally formed with said arcuate wall portion of said housing closely adjacent one end of said flat portion so that said handle is longitudinally aligned in a direction substantially parallel to said elongated edge and substantially coplanar with said end wall, and spaced upwardly apart from said elongated flat portion, so that with said elongated flat portion lying on a flat surface, said handle is spaced upwardly from the surface by an amount sufficient so that with said handle grasped by a human hand, the hand is spaced upwardly from said surface wherein the longitudinal length of said elongated flat portion is greater than the longitudinal length of said handle so that, with said flat portion resting on a support surface, said handle remains in a raised position.

* * * * *